US011623331B1

(12) United States Patent
Loveridge

(10) Patent No.: US 11,623,331 B1
(45) Date of Patent: Apr. 11, 2023

(54) NAIL HOLDING PLIERS

(71) Applicant: Alan Dale Loveridge, Marcellus, MI (US)

(72) Inventor: Alan Dale Loveridge, Marcellus, MI (US)

( * ) Notice: Subject to any disclaimer, the term of this patent is extended or adjusted under 35 U.S.C. 154(b) by 0 days.

(21) Appl. No.: 17/809,738

(22) Filed: Jun. 29, 2022

(51) Int. Cl.
*B25C 3/00* (2006.01)
*B25B 7/02* (2006.01)

(52) U.S. Cl.
CPC ..... *B25C 3/008* (2013.01)

(58) Field of Classification Search
None
See application file for complete search history.

(56) References Cited

U.S. PATENT DOCUMENTS

| | | | | |
|---|---|---|---|---|
| 1,276,256 A | | 8/1918 | Oreardon | |
| 1,420,988 A | * | 6/1922 | Foehl | G02C 13/001 81/3.6 |
| 2,264,166 A | * | 11/1941 | Lipson | B25C 11/00 7/125 |
| 2,349,339 A | | 5/1944 | Cloer | |
| 2,457,689 A | | 12/1948 | Krieg | |
| 2,628,519 A | | 2/1953 | Hand | |
| 2,668,538 A | * | 2/1954 | Baker | A61B 17/282 81/426 |
| 2,716,750 A | * | 9/1955 | Biblis | B25C 3/008 81/44 |
| 2,836,999 A | | 6/1958 | Ly | |
| 2,842,997 A | | 7/1958 | Wentling | |
| 4,079,765 A | | 3/1978 | Hatayan | |
| 4,386,542 A | | 6/1983 | Verna | |
| 4,730,524 A | | 3/1988 | Petersen | |
| 6,493,892 B2 | | 12/2002 | Kang | |
| 6,934,991 B2 | | 8/2005 | Kinkade | |
| 9,566,691 B2 | | 2/2017 | Ford | |
| 2006/0053563 A1 | | 3/2006 | Skinner | |
| 2008/0163729 A1 | | 7/2008 | Stevens | |
| 2015/0246432 A1 | | 9/2015 | Craig et al. | |
| 2019/0084140 A1 | | 3/2019 | Cooke | |

FOREIGN PATENT DOCUMENTS

GB 2499614 A * 8/2013 ..... B25C 3/008

OTHER PUBLICATIONS

Glarks 1Pc nails hold plier plastic safety plier finger . . . —amazon com. (n.d.). Retrieved Jun. 23, 2022, from https://www.amazon.com/Glarks-Plastic-Protector-Hammering-Position/dp/B09P55NBL7.

* cited by examiner

*Primary Examiner* — Brian D Keller
(74) *Attorney, Agent, or Firm* — Dunlap Bennett & Ludwig, PLLC

(57) ABSTRACT

Pliers for holding nails prior to driving the nails is disclosed. The two opposing jaws portions of the pliers provide V-shaped recesses and complementary V-shaped protrusions, respectively, for temporarily securing a shaft of a nail. A hold-open element may operatively associate with one of the jaw portions so that it may be selectively moved against the opposing jaw portion for slightly decreasing the hold of the engaged V-shaped recess and protrusion so that a hammer may more easily drive the held nail. The opposing jaw portions may separately define a diagonally oriented passageway in an open mode for a user to hold a nail in an approximately 45-degree angled, relative to the longitudinal axis of the jaw portions.

10 Claims, 6 Drawing Sheets

NAIL HOLDING PLIERS

BACKGROUND OF THE INVENTION

The present invention relates to plier-type tools and, more particularly, a nail holding pliers for long and short nails.

Holding nails steady in advance of driving them into a substrate can be critical to optimally completing a project. There are times that tight spaces prevent a user from using their fingers to hold the nail, and so there is a need for a tool for such situations.

Furthermore, driving nails at 45-degree angles are required to produce a strong joint; for instance, when toe-nailing or blind nailing. Again, suboptimal access to the nail head can make driving 45-degree nails a challenge, especially for the non-professionals.

There is no one tool that provides satisfactory solutions to the above challenges. There are some nail-holding tools, but they are flawed through providing only a series of different hole sizes and so are not adapted or configured for holding short nails. Furthermore, these current nail-holding tools have no 45-degree angle nail holding functionality.

For professionals or do-it-yourselfer, it is well understood that it is a boon to have a single tool that can replace two tools during a construction project.

As can be seen, there is a need for a nail holding pliers for long and short nails, that is also adapted to provide 45-degree angle nail-holding functionality.

To wit, the present invention provides triangular recesses and protrusions in the opposing faces of its plier jaws, wherein a shaft of a nail may be held perfectly straight, pinched between the protrusion and the recess, enabling the user to hold and manipulate the nail.

A second set of complementary wedge protrusion and recess are dimensions and adapted to secure nails at an angle approximately 45-degrees relative to the longitudinal axis of the jaws.

The tool may provide a hold open element designed to slightly loosen the pinching hold on the held nail, affording it slight slide-ability or freedom of movement so that the nail does not pull the pliers into the work piece when driven. The distal portion of the jaws may be only approximately an eighth of an inch thick so even nails only approximately a half of an inch long can be started for approximately a quarter of an inch before the user needs to open the pliers and finish the job.

The present invention enables user to make a more accurate 45-degree nailing and holds nails at a very precise angle with very little clearance. Particularly on short nails (e.g., one inch or less in length) the present invention facilitates holding nails in tight spaces and reduces the chances of hand injury; for instance, by enabling a user getting closer to a corner.

SUMMARY OF THE INVENTION

In one aspect of the present invention, a device includes the following: a first jaw face and a second jaw face pivotably coupled to move between an open mode and a closed mode so that said faces interface in the closed mode; a plurality of V-shaped protrusions disposed on along first jaw face; and a plurality of V-shaped recess disposed along the second jaw face in such a way that in the closed mode said protrusions snugly nest in said recesses, wherein each jaw face has a distal portion and a proximal portion, and wherein a width of each jaw face along the distal portion is approximately half that of proximal portion, wherein the width of each jaw face along the distal portion is approximately one-eighth of an inch, wherein one V-shaped recess of the plurality of V-shaped recesses is oriented approximately 45-degrees relative to non-recessed portions of the first jaw face, wherein all other V-shaped recesses of the plurality of V-shaped recesses are oriented approximately parallel relative to non-recessed portions of the first jaw face and orthogonal relative to a longitudinal axis of the first jaw face, and wherein there is at least one orthogonal V-shaped recess on the distal portion and at least one orthogonal V-shaped recess on the proximal portion; and further including a hold-open element operatively associated with one of said jaw faces so as to move between a disengaged position and an engaged position urging against an opposing jaw face.

In one aspect of the present invention, a device includes the following: a first jaw face and a second jaw face pivotably coupled to move between an open mode and a closed mode so that said faces interface in the closed mode; a longitudinal rectangular groove in the first jaw face, wherein the groove terminates at a nose of said first jaw face; opposing longitudinal cleft faces defined in the first jaw face by the rectangular groove; a V-shaped recess formed in each cleft faces; and a rectangular tooth protruding from the second jaw face so that it is slidably received in the rectangular groove in the closed mode; further including a substantially semicircular recessed form in each jaw faces so that in the closed mode, a substantially circular tube slot is defined; and further including a closure hook and hook post on opposing handle portions, respectively, of said jaw faces, wherein the closure hook is pivotably connected so as to disengage and engage from and to the hook post between an unlocked engagement and a locked engagement, respectively, of said jaw faces.

In yet another aspect of the present invention, a method of selectively holding a nail, the method including the following: providing the above-mentioned device; urging one of the plurality of V-shaped recesses and its operatively associated V-shaped protrusion against the nail; and moving the hold-open element from the disengaged position and the engaged position.

These and other features, aspects and advantages of the present invention will become better understood with reference to the following drawings, description and claims.

DETAILED DESCRIPTION OF THE INVENTION

Figure 1:
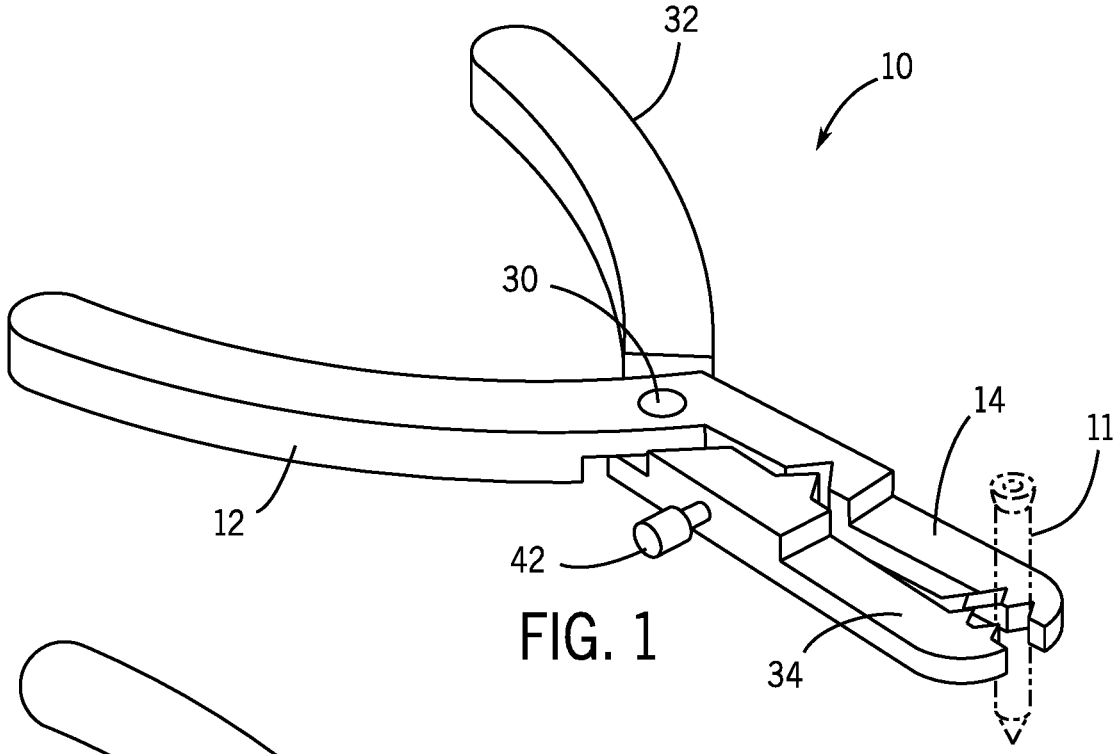
FIG. 1 is a front perspective view of an exemplary embodiment of the present invention, shown in use.
Figure 2:
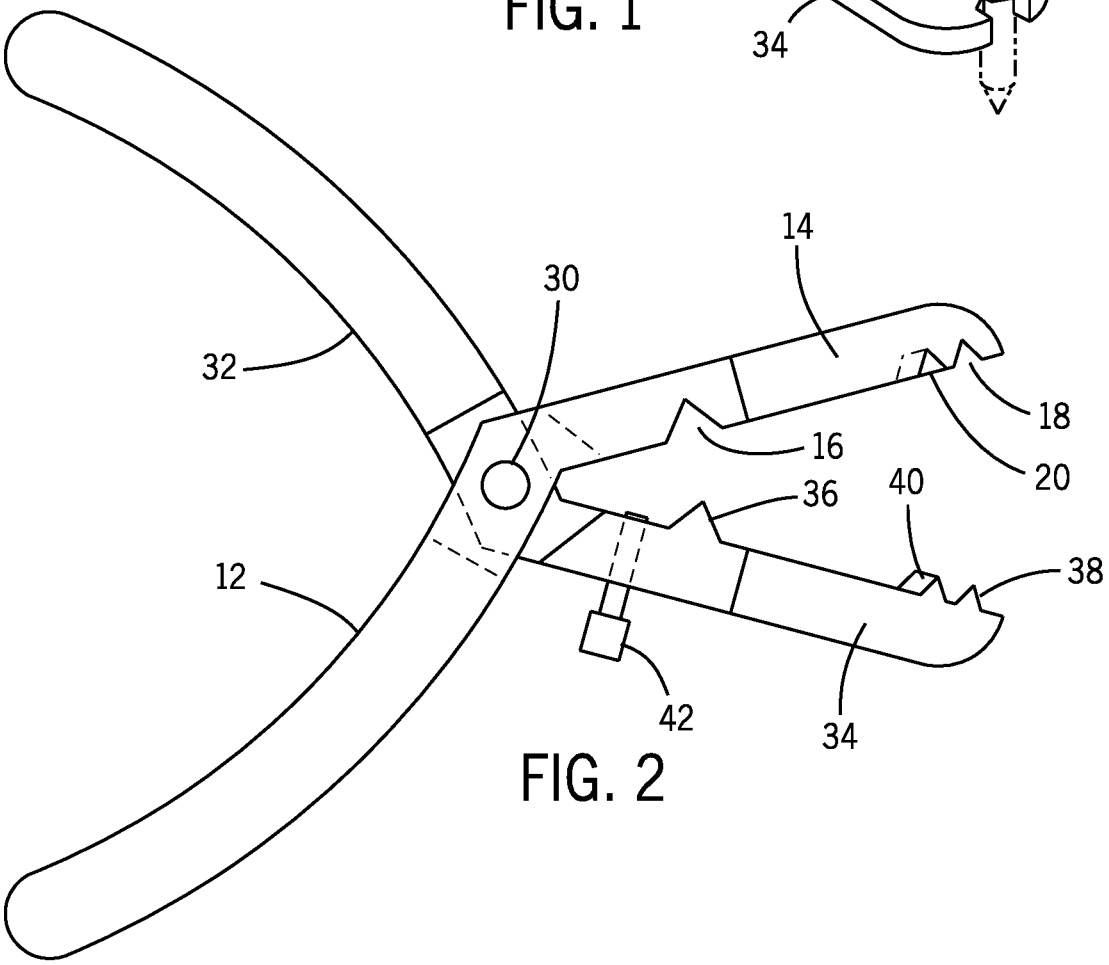
FIG. 2 is a side elevation view of an exemplary embodiment of the present invention, shown in an open mode.
Figure 3:
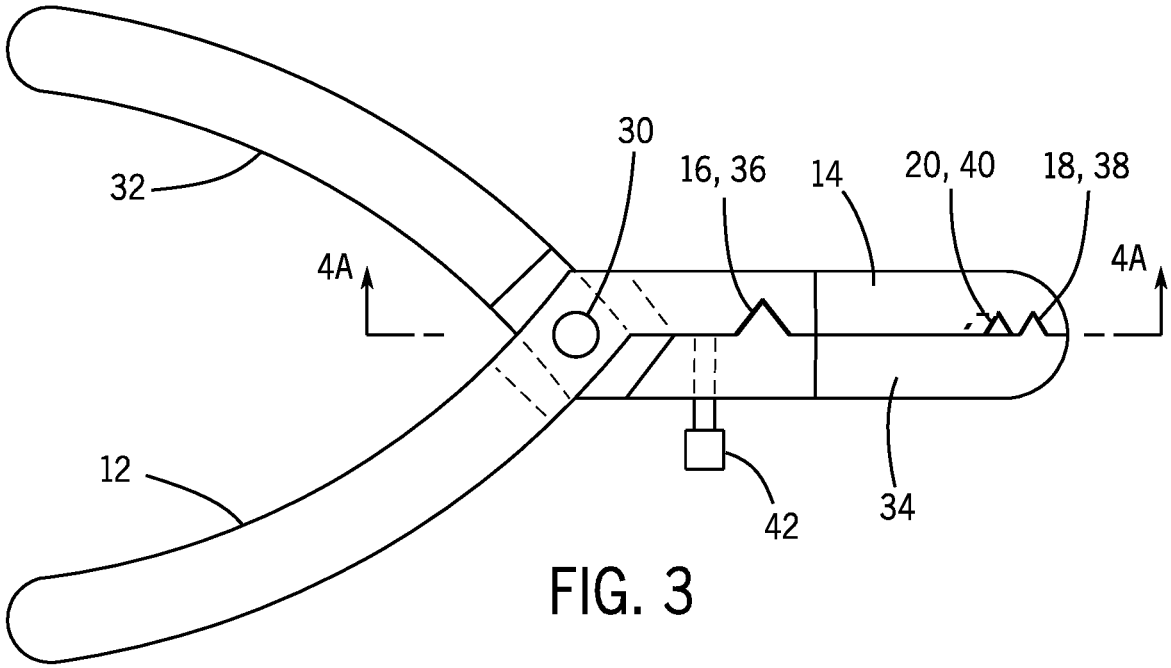
FIG. 3 is a side elevation view of an exemplary embodiment of the present invention, shown in a closed mode.
Figure 4A:
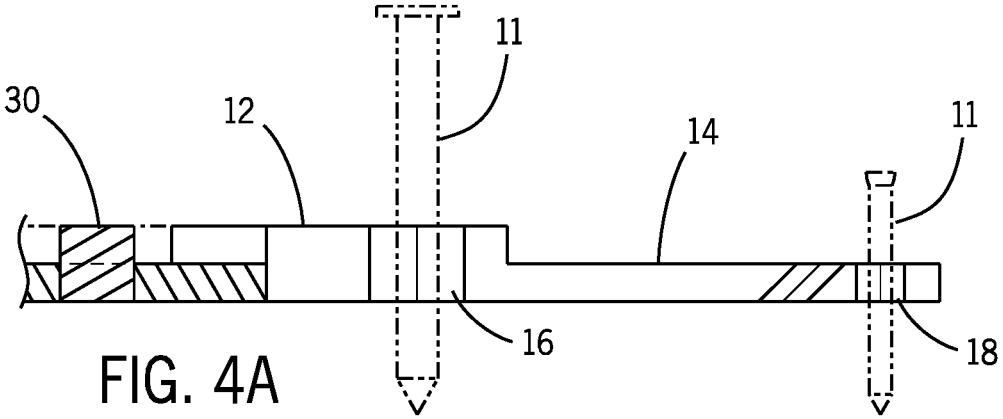
FIG. 4A is a detailed cross-sectional view taken along line 4A-4A of FIG. 3, showing a first used condition orthogonally holding a nail 11 (the orthogonal orientation being defined relative to the longitudinal plane); it is understood that in the completely closed condition of FIG. 3 that present invention could not hold the nail 11 as shown; and it is further understood from FIGS. 3 and 4A that the angled recess 20 can be oriented 45-degrees relative to its jaw face in at least two orientations in different embodiments.
Figure 4B:
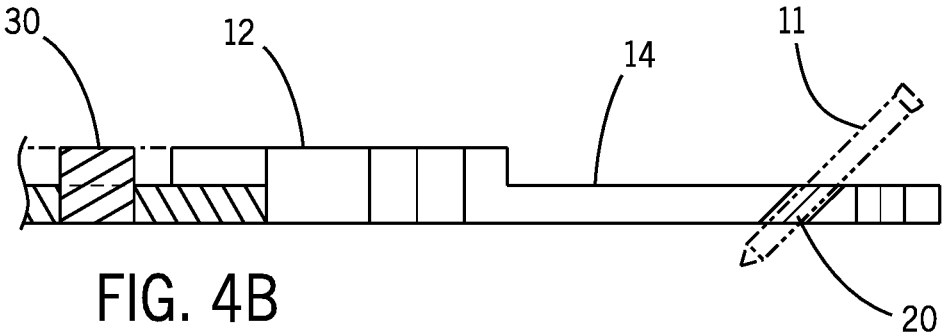
FIG. 4B is a detailed cross-sectional view similar to FIG. 4A illustratively showing in a second used condition diagonally holding a nail 11 (the orthogonal orientation being defined relative to the longitudinal plane); it is understood that in the completely closed condition of FIG. 3 that present invention could not hold the nail 11 as shown.
Figure 5:
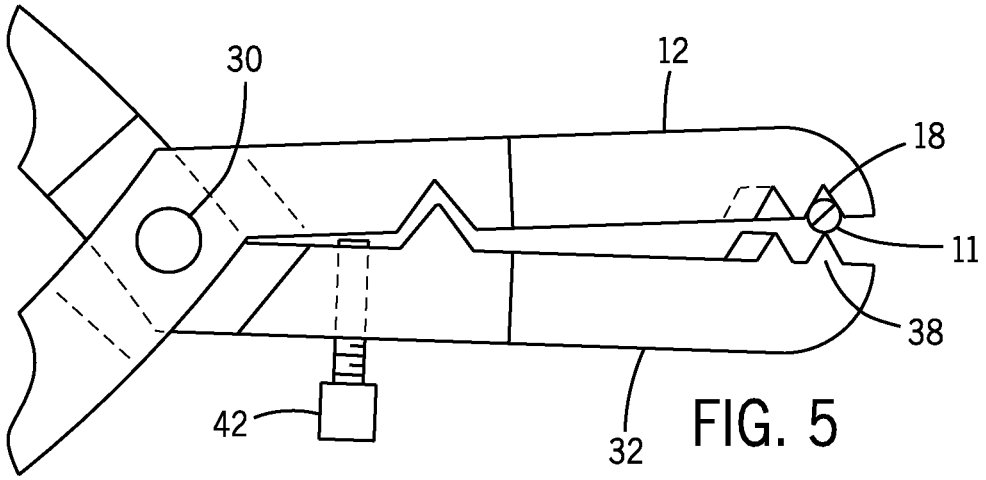
FIG. 5 is a detail side elevation view of an exemplary embodiment of the present invention, shown in the first used condition with a small nail 11.
Figure 6:
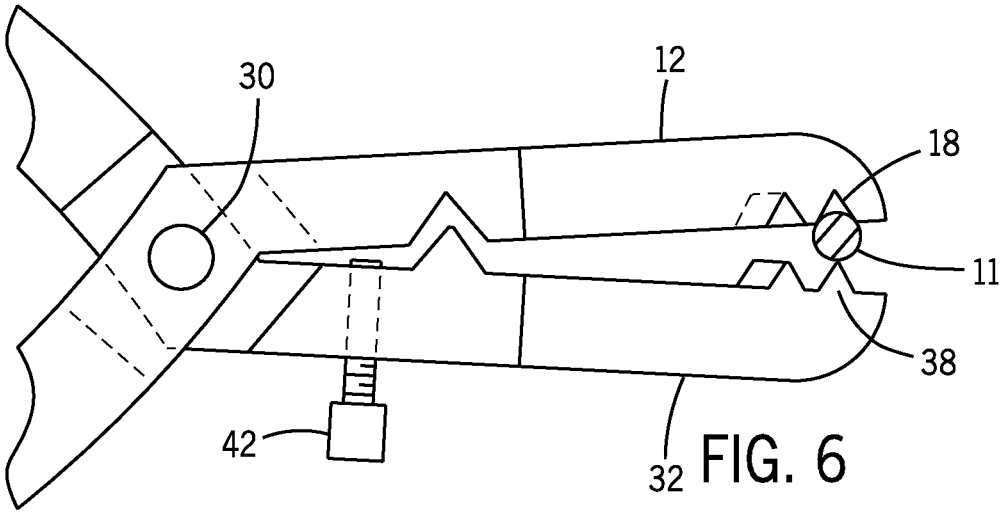
FIG. 6 is a detail side elevation view of an exemplary embodiment of the present invention, shown in the first used condition adjusted to accommodate a large nail 11.
Figure 7:
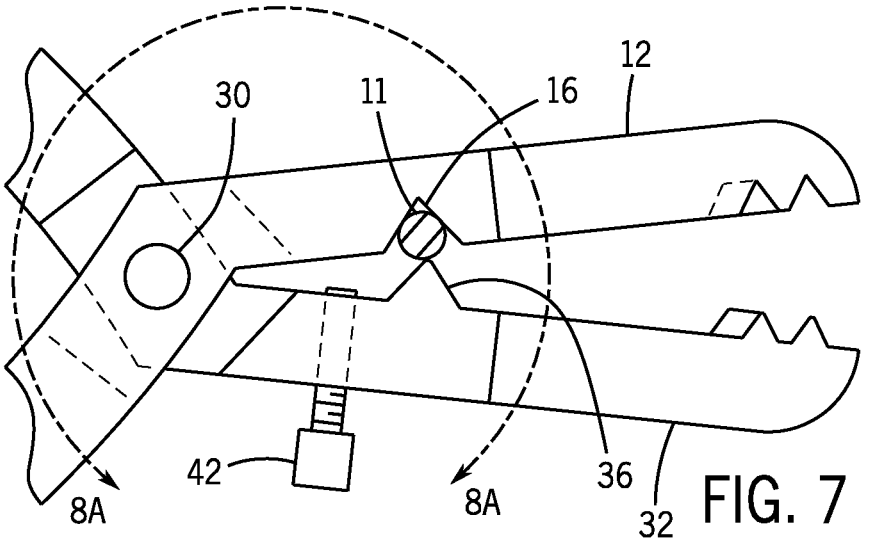
FIG. 7 is a detail side elevation view of an exemplary embodiment of the present invention, shown in the first used condition using different, proximal V-shaped protrusion and recess set to accommodate the large nail 11.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention includes pliers for holding nails prior to driving the nails. The two opposing jaws portions of the pliers provide V-shaped recesses and complementary V-shaped protrusions, respectively, for temporarily securing a shaft of a nail. A hold-open element may operatively associate with one of the jaw portions so that it may be selectively moved against the opposing jaw portion for slightly decreasing the hold of the engaged V-shaped recess and protrusion so that a hammer may more easily drive the held nail. The opposing jaw portions may separately define a diagonally oriented passageway in an open mode for a user to hold a nail in an approximately 45-degree angled, relative to the longitudinal axis of the jaw portions.

Referring now to FIGS. 1 through 12, the present invention may include a nail-holding pliers 10 and having opposing handle portions 12 and 32 pivoted together at pivot point 30 for manipulating their contacting jaw portions. Each jaw portion may have proximal portion and a distal portion 14, 34. The distal portion 14, 34 may have a lower profile or thickness than its proximal portion. In certain embodiments, the distal portions 14, 34 may have a thickness of approximately one-eighth of an inch, while the proximal end may be approximately twice that.

The jaw portions may have a V-shaped protrusion 36, 38 and complementary V-shaped recess 16, 18 on opposing jaw faces at the proximal portions (36, 16) and the distal portions (38,18). These sets of V-shaped protrusion 36, 38 and V-shaped recess 16, 18 are inward of the outer end of their respective portion.

Also provided by the complementary jaw portions may be a wedge protrusion 40 and a complementary wedge recess 20, both dimensioned and adapted so that when the distal portions 14, 34 move to the closed position, the wedge protrusion 40 nests snugly in the wedge recess 20. Thus, in the open mode the wedge recess 20 defines a 45-degree angled passageway, wherein the passageway is oriented at an angle approximately 45-degrees relative to the longitudinal axis of the jaw portions.

In one embodiment, the wedge recess 20 is a V-shape recess that are formed into a distal portion at an approximately 45-degree angle relative to the longitudinal plane (defined by the longitudinal axis) as compared to the above-mentioned V-shaped recess 16, 18, which are formed into a distal portion at a 90-degrees angle (orthogonally) relative to the longitudinal plane. The wedge protrusion 40 may be a V-shape that similarly extends at an approximately 45-degree angle relative to said longitudinal plane, so that when it nests into the wedge recess 20 the 45-degree angled passageway is occupied. Thus, when the pliers 10 moves from the open mode to the closed mode a nail 11 is engaged ("held") between the wedge protrusion 40 and the defining walls of the wedge recess 20 at an angle approximately 45-degrees relative to said longitudinal plane.

It is understood that even though the figures show the recesses 18 and 20 formed into the upper distal portion 14, they may alternatively be formed into the lower distal portion 32 or lower proximal portion.

Figure 8A:
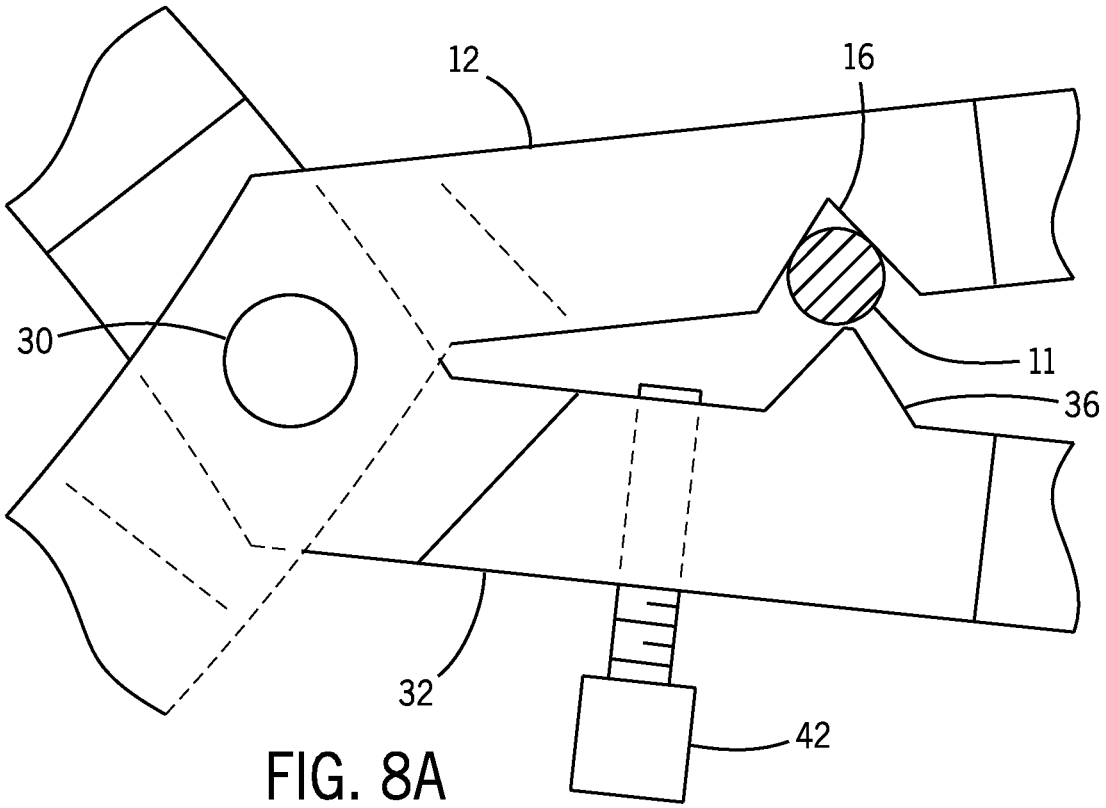
FIG. 8A is an enlarged detail side elevation view taken along line 8A-8A in FIG. 7.
Figure 8B:
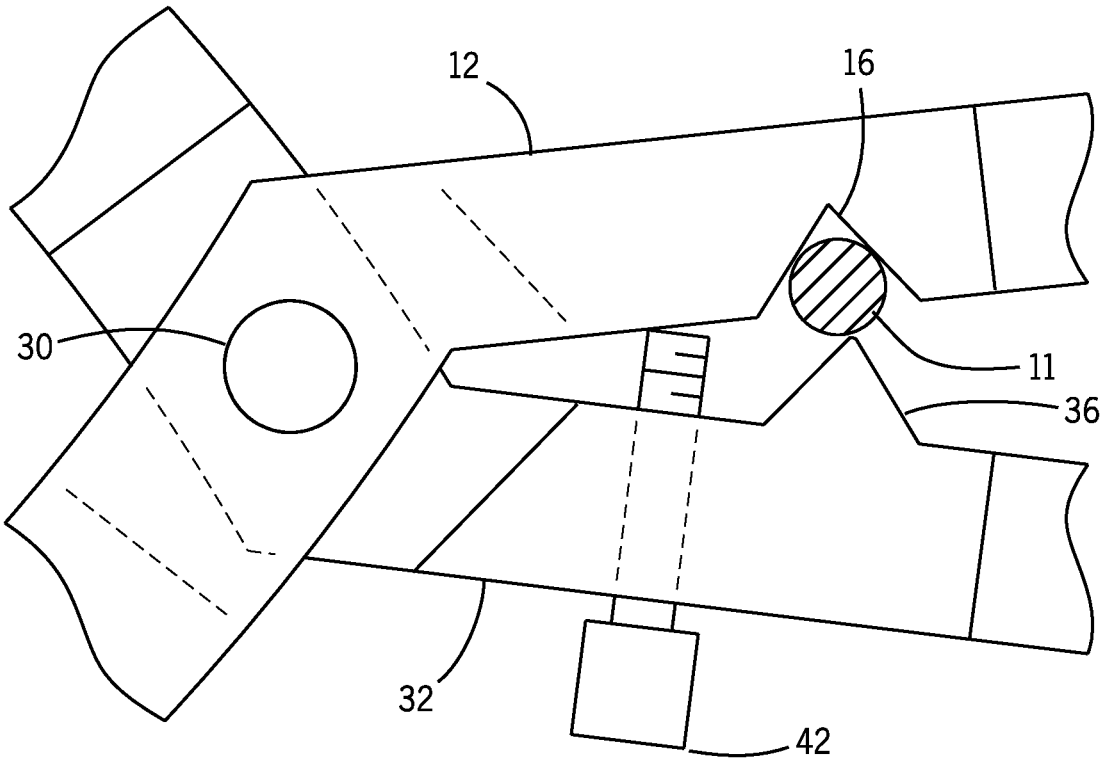
FIG. 8B is an enlarged detail side elevation view similar to FIG. 8A, illustrating deployment of the hold-open screw to loosen the grip on the nail 11 prior to driving the nail 11 so that the pliers does not get frictionally dragged with the driven nail 11.

Referring to FIGS. 8A and 8B, another embodiment of the present invention contemplates a hold-open element 42 may be disposed on one of the jaw portions, whereby the threaded hold-open element 42 may be moved between a first position that does not contact the opposing jaw portion in the closed mode and a second position wherein the hold-open element 42 contacts the opposing jaw portion before it can fully close. The hold-open element may be any threaded (or non-threaded) structure, such as a bolt through a jaw hole, that functions are herein described.

Referring to FIGS. 9A through 10B, in another embodiment, pliers 50 with first and second handle-jaw elements 52 and 62, may provide a tube slot 60 by the way of complementary semi-circular cutouts 67.

Figure 9A:
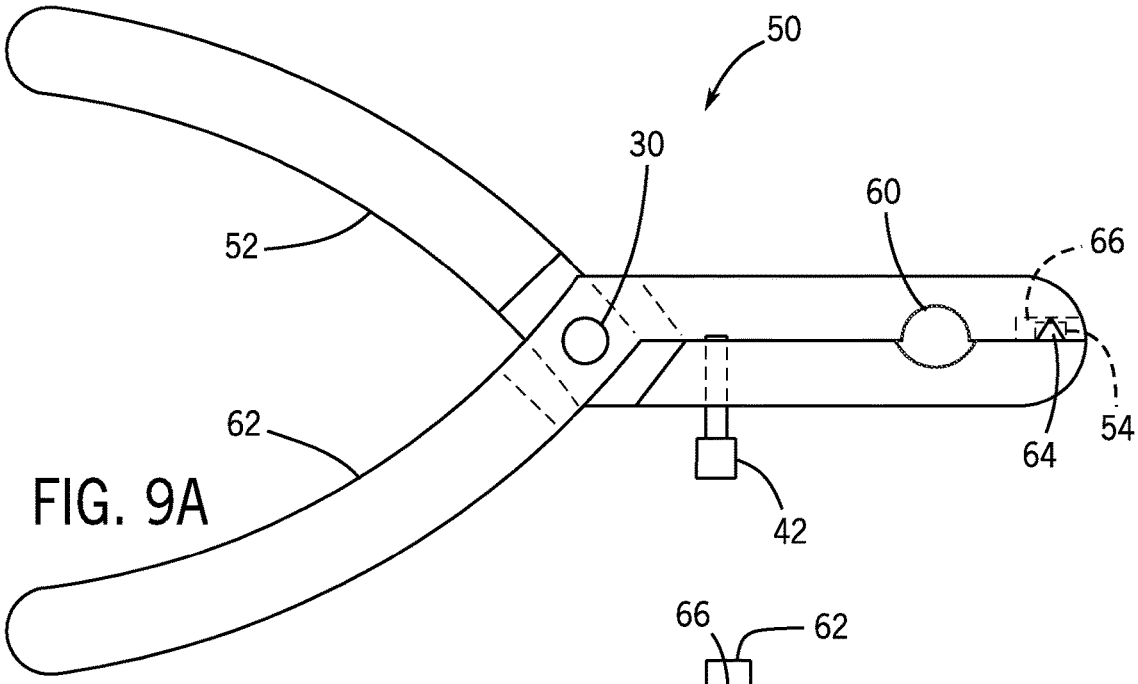
FIG. 9A is a side elevation view of an exemplary embodiment of the present invention, shown in a closed mode.
Figure 9B:
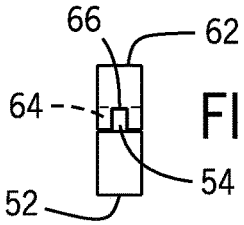
FIG. 9B is a front elevation view of an exemplary embodiment of the present invention, shown in the closed mode.
Figure 10A:
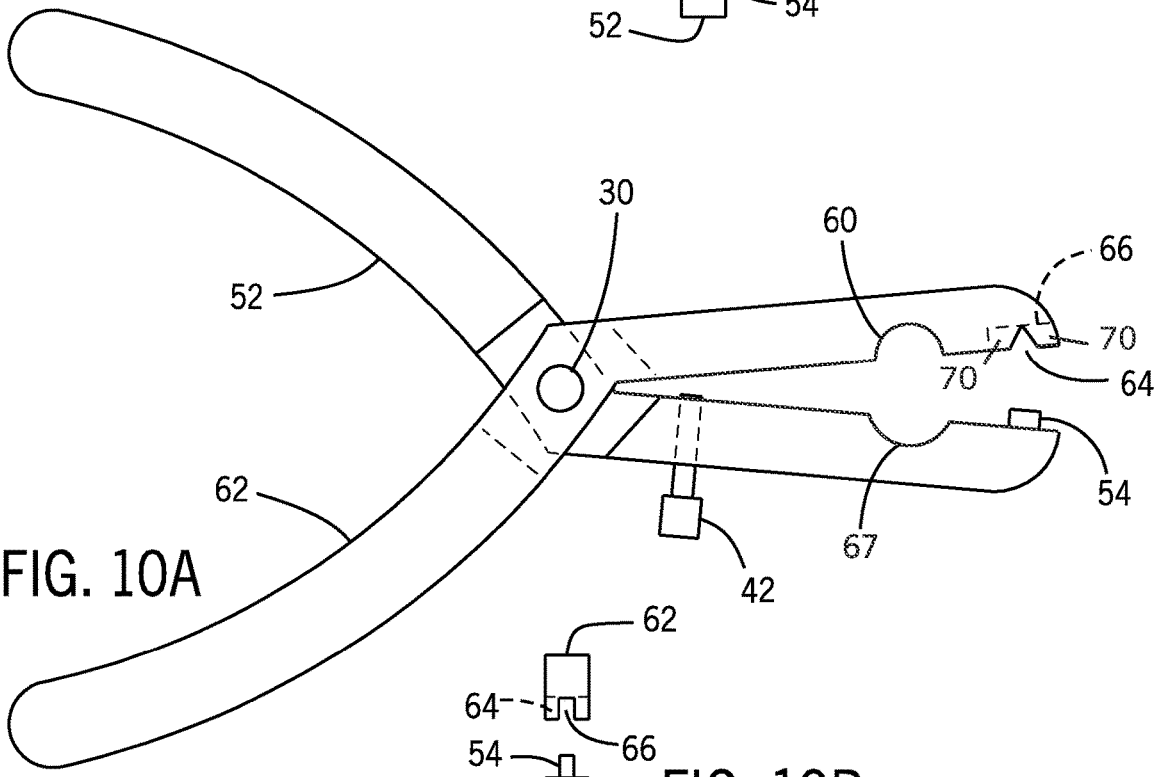
FIG. 10A is a side elevation view of an exemplary embodiment of the present invention, shown in an open mode.
Figure 10B:
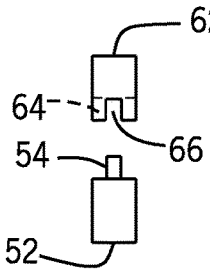
FIG. 10B is a front elevation view of an exemplary embodiment of the present invention, shown in the open mode.

Also, along its nose, the pliers 50 may provide a longitudinal rectangular groove 66 disposed centrally in one of the two jaw faces, wherein the longitudinal rectangular groove 66 defines opposing longitudinal cleft faces 70 in the respective jaw face. A 90-degree V-shaped recess 64 may be formed in the cleft faces 70, as illustrated in FIGS. 9A and 10A. A rectangular tooth 54 on the opposing jaw face may be slidably be received in the longitudinal rectangular groove 66 in a closed mode of the jaws, so that it can hold and head of nail 11 for removing it from a workpiece. This structure can also be used to engage the shaft of a nail 11 to bend it straight, for example, if it has been mishit into a workpiece so that its shaft is bent.

Figure 11:
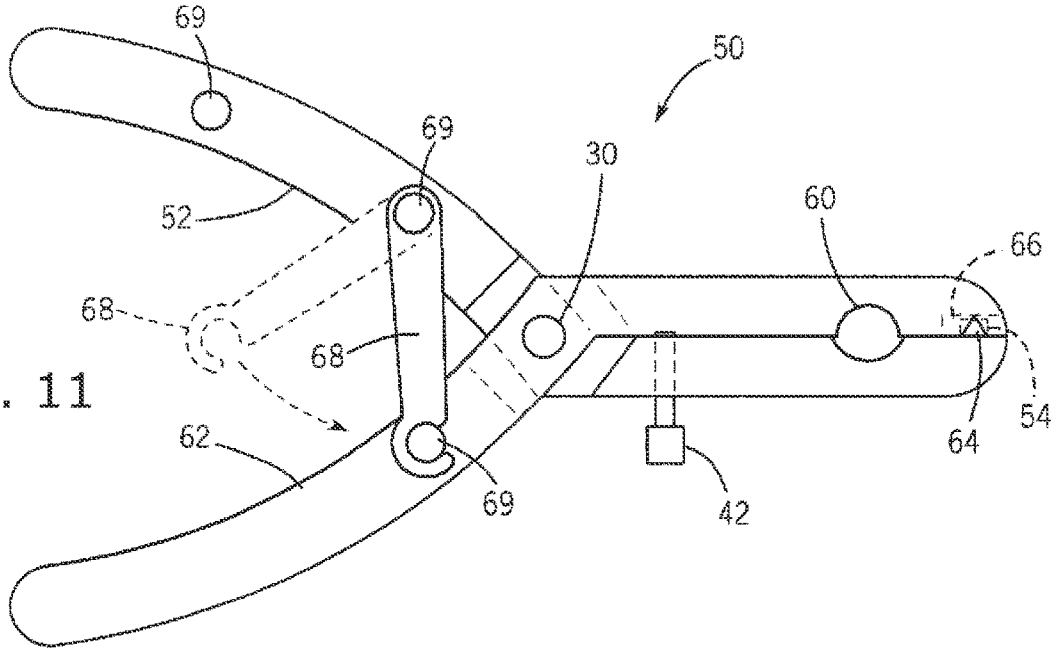
FIG. 11 is a side elevation view of an exemplary embodiment of the present invention, shown in a closed mode and a locked engagement therein.
Figure 12:
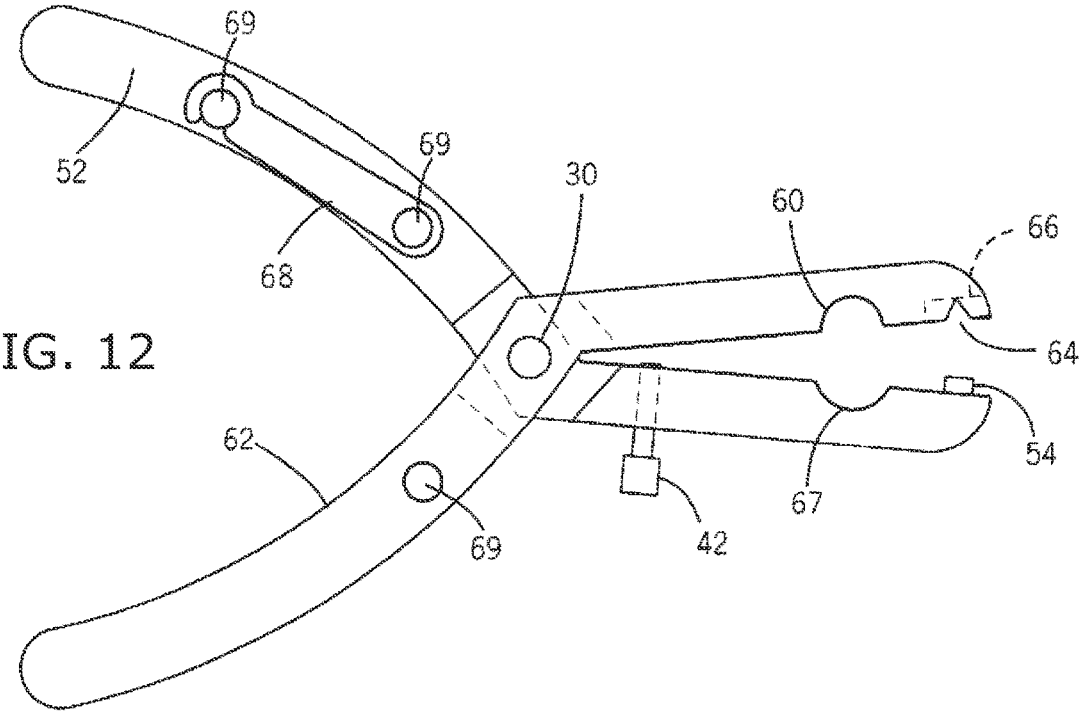
FIG. 12 is a side elevation view of an exemplary embodiment of the present invention, shown in an open mode.

Referring to FIGS. 11 and 12, yet another embodiment of the present invention contemplates a closure hook 68 and hook post 69 on opposing handle portions 52 and 62 so that the closure hook 68 can operatively associate with the hook post 6 to secure the pliers 50 in a locked engagement in the closed mode.

The V-shape recesses 16 and 18 and V-shaped protrusions 36 and 38 are critical in holding the nails 11. The V-shaped protrusions 36 and 38 may resemble teeth. In some embodiments, the distal end of the tooth/V-shape may be cutoff (e.g., having a flat top as opposed to pointy top). Similarly, V-shape recesses 16 and 18 may have a flat top.

A method of using the present invention may include the following. A user may put a nail 11 within the V-shaped recess 16 or 18 that best fits that sized nail 11. Then the user manipulates the handles and clamps the pliers down on the nail. Then the user may adjust the hold open element 42 until it moves the jaw slightly apart, just giving the nail 11 a little sliding space for driving it into a work piece (not shown) with a hammer or other tool.

On long nails 11 a user may decide not to use the hold open element 42 as long as they stop before the nail 11 rides the plyers into the work piece. For example, if a person was making a wooden box, one would use the pliers 10 or 50 to hold the nail 11 straight so it would not be as apt to bend over or split wood.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "diagonal" means substantially 45-degrees or forming an angle between 35.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A device, comprising:

a first jaw face and a second jaw face pivotably coupled to move between an open mode and a closed mode so that said faces interface in the closed mode;

wherein opposing outermost sides of the second jaw face, respectively, are defined by two longitudinal edges;

an angled V-shaped recess extending between and including the two longitudinal edges, wherein the angled V-shaped recess extends at an approximately 45-degrees angle relative to each longitudinal edge;

an angled V-shaped protrusion disposed along the first jaw face in such a way that in the closed mode said protrusion nests in said recess.

2. The device of claim 1, wherein each jaw face has a distal portion and a proximal portion, and wherein a width of each jaw face along the distal portion is approximately half that of proximal portion.

3. The device of claim 2, wherein the width of each jaw face along the distal portion is approximately one-eighth of an inch.

4. The device of claim 1, further comprising:

one or more orthogonal V-shaped recesses disposed along the second jaw face, wherein each orthogonal V-shaped recess extends between and includes the two longitudinal edges so as to be disposed approximately orthogonal relative said two longitudinal edges; and one or more orthogonal V-shaped protrusions disposed along the first jaw face.

5. The device of claim 4, wherein the second jaw face is a flat surface interrupted by said V-shaped recesses.

6. The device of claim 4, wherein movement between the open and closed modes is about an axis of rotation, and wherein the axis of rotation is parallel with each orthogonal V-shaped recess.

7. The device of claim 1, further comprise a hold-open element operatively associated with one of said jaw faces so as to move between a disengaged position and an engaged position urging against the opposing jaw face.

8. The device of claim 1, wherein a nail occupying the angled V-shaped recess protrudes beyond both opposing outermost sides of the second jaw face.

9. A method of selectively holding a nail, the method comprising:

providing the device of claim 7;

urging the angled V-shaped recess and its operatively associated angled V-shaped protrusion against the nail; and moving the hold-open element from the disengaged position and the engaged position.

10. The method of claim 9, wherein the nailed is oriented approximately 45-degrees relative the second jaw face.

* * * * *